US005737888A

United States Patent [19]

Shimek et al.

[11] Patent Number: 5,737,888

[45] Date of Patent: Apr. 14, 1998

[54] VERSATILE SURROUND TRIM STRUCTURE

[75] Inventors: Daniel Curtis Shimek, Apple Valley; Ronald John Shimek, Prior Lake, both of Minn.

[73] Assignee: Heat-N-Glo Fireplace Products Inc., Savage, Minn.

[21] Appl. No.: 588,864

[22] Filed: Jan. 19, 1996

[51] Int. Cl.[6] ..... E04F 19/00

[52] U.S. Cl. ..... 52/312; 52/36.3; 52/287.1; 52/387; 40/489; 40/618

[58] Field of Search ..... 52/311.2, 311.3, 52/312, 287.1, 288.1, 385, 386, 387, 506.02, 506.08, 506.09, 506.1, 778, 36.3; D23/404; 40/489, 490, 618

[56] References Cited

U.S. PATENT DOCUMENTS

| | | | |
|---|---|---|---|
| D. 300,356 | 3/1989 | Becker, Jr. | D23/404 |
| 318,126 | 5/1885 | Marsh | 52/387 X |
| 421,741 | 2/1890 | Marsh | 52/387 |
| 421,742 | 2/1890 | Marsh | 52/311.2 X |
| 503,369 | 8/1893 | Holliday et al. | 52/387 |
| 1,171,717 | 2/1916 | Haddox | D23/404 X |
| 1,524,668 | 2/1925 | Miller et al. | 40/618 |
| 1,747,400 | 2/1930 | Stewart et al. | 40/576 |
| 2,101,612 | 12/1937 | Duffy | 52/386 X |
| 2,156,257 | 5/1939 | Adler | 40/618 |
| 2,576,983 | 12/1951 | Walker | 40/618 |
| 2,579,943 | 12/1951 | Marchand | 52/312 |
| 2,608,777 | 9/1952 | Schuler | 40/650 |
| 3,728,833 | 4/1973 | Grossman | 52/288.1 X |
| 3,742,633 | 7/1973 | Palm | 40/576 |
| 3,775,926 | 12/1973 | Brown et al. | 52/312 X |
| 4,213,260 | 7/1980 | Brown | 40/618 X |
| 4,274,237 | 6/1981 | Hagstrom | 52/312 |
| 4,944,129 | 7/1990 | Hartleif | 52/506.08 |

FOREIGN PATENT DOCUMENTS

| | | | |
|---|---|---|---|
| 1371128 | 7/1964 | France | 52/288.1 |
| 640144 | 5/1962 | Italy | 40/618 |
| 1587185 | 4/1981 | United Kingdom | 40/618 |
| 2063056 | 6/1981 | United Kingdom | 52/312 |

*Primary Examiner*—Carl D. Friedman
*Assistant Examiner*—Laura A. Callo
*Attorney, Agent, or Firm*—John B. Sowell-Att.

[57] ABSTRACT

A versatile surround trim mounting device comprises an extruded metal surround trim piece formed as three separate legs and joined together to form a U-shaped frame structure. The extrusion comprises a pair of parallel trim edges that are separated from each other by a connecting recessed tile support therebetween. The recessed tile support is further provided with two side support structures. A spring bias force is placed against one of the side supports to urge a tile to lock it against the opposite side support so that the versatile surround trim appears to the eye be horizontal and vertical rows of decorative tiles surrounding a prefabricated fireplace.

7 Claims, 2 Drawing Sheets

VERSATILE SURROUND TRIM STRUCTURE

BACKGROUND OF THE INVENTION

1. Field of the Invention

The present invention relates to decorative trim structures and a mounting structure for decorative trim tiles. More particularly, the present invention relates to a holder or mounting structure for holding removable decorative tile shaped ornamental indica which may be mounted on numerous appliances for various decorative purposes.

2. Description of the Prior Art

Heretofore there have been commercially available wall paper and plastic sheet material having a pattern on one side and an adhesive on the other side. Such paper and sheet materials have been used by homemakers and decorators to cover appliances, cabinets and various wall and shelf surfaces.

Such adhesive backed decorative materials cannot be used on stoves and fireplaces or other high heat environmental areas without the adhesive degrading and degenerating and/or creating a fire hazard. To overcome the heat problem, fireplace manufacturers have employed magnets attached to decorative strips which have been placed as a decorative trim on gas fireplace units. Similar magnetic trim pieces are commercially available for refrigerators as outer metal panels or surfaces for protection of the edges of the refrigerator.

It has been fairly common practice to mount ceramic tiles on vertical and horizontal surfaces surrounding a masonry fireplace. When prefabricated gas fireplace units are installed in new or old homes, it has been common practice to add a custom made or prefabricated mantel and/or hearth which include ceramic tiles or marble that is permanently attached by grout or heat resistant materials. Such prior art fireplaces use pre-cut pieces of tile, marble or granite, etc. that cannot be altered in the field without destroying the original mantel or hearth and rebuilding it anew. It is well known by fireplace and mantel builders that slabs of pre-cut glass, marble and other ceramic materials present numerous problems in pre-cutting shipping and breakage and subsequent problems of delays in matching original materials in the event of loss or breakage of the original materials.

It would be desirable to provide a trim mounting structure which will eliminate problems which occur in the field as well as minimizing problems associated with shipping and breaking and permit decorators the option of changing decorative tiles with little or no cost while reducing the cost of the original decorative trim installation around the fireplace or other appliances.

SUMMARY OF THE INVENTION

It is a principal object of the present invention to provide a versatile surround trim mounting structure.

It is a principal object of the present invention to provide a novel tile retaining mounting structure capable of removably holding squares of rectangular decorative blocks of surround material.

It is a principal object of the present invention to provide a fireplace surround trim piece which removably retains colored glass, leaded glass, mirrors, marble, metal tiles and blocks, photographically finished metal or ceramic tiles, customized tiles, wood and plastic tiles and blocks and/or decal ornamented tiles and blocks for installation around a hot fireplace.

It is an object of the present invention to provide a versatile surround trim that removably retains tile shaped objects in a resiliently locked position.

According to these and other objects of the present invention, there is provided a novel versatile surround trim mounting structure for flush mounting on the outer surface of an appliance or the surface surrounding a fireplace that is heated which comprises a formed metallic trim piece having a pair of shaped trim edges. One trim edge has a short tile retaining extension and the other trim edge has a long tile retaining extension which extends over a resilient tile retaining device. A recess between the tile retaining extensions is adapted to receive and support tiles placed therein. Preferably, the back of the versatile surround trim is provided with a heat isolating stand-off to prevent direct conduction of heat from a heat source into the decorative tiles retained in the recess by the retaining extensions.

DETAILED DESCRIPTION OF THE PREFERRED EMBODIMENT

Figure 1:
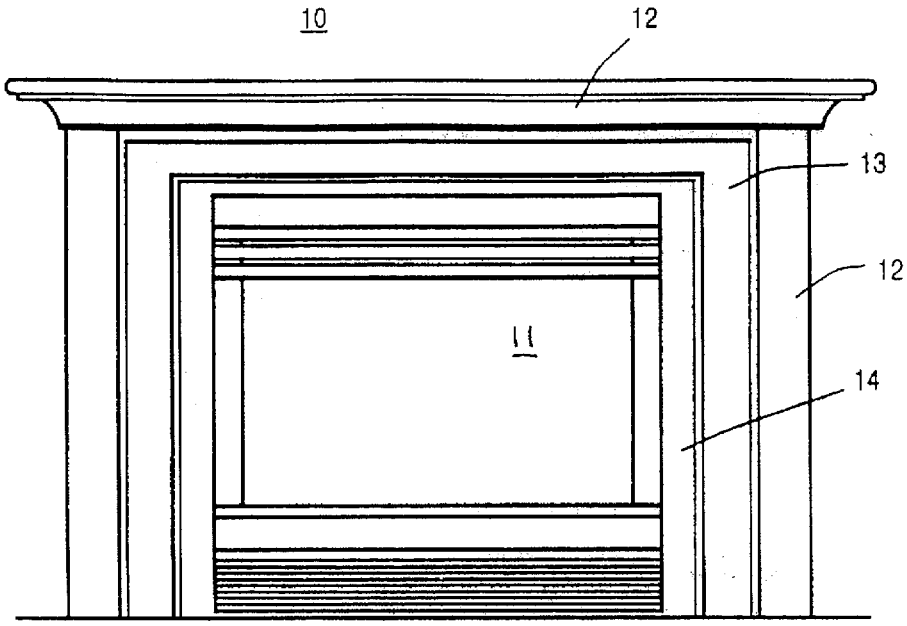
FIG. 1 is a front elevation view of a fireplace comprising a mantel and a gas fireplace insert unit showing the present invention versatile surround trim surrounding the gas insert unit.

Refer to FIG. 1 showing a front elevation view of a fireplace 10 comprising a prefabricated fireplace unit 11 (not shown) and a decorative mantel 12 which may be prefabricated or custom built. There is provided mounted on the flat surface of the decorative mantel 12 a versatile surround trim 13 which will now be explained in greater detail.

Figure 2:
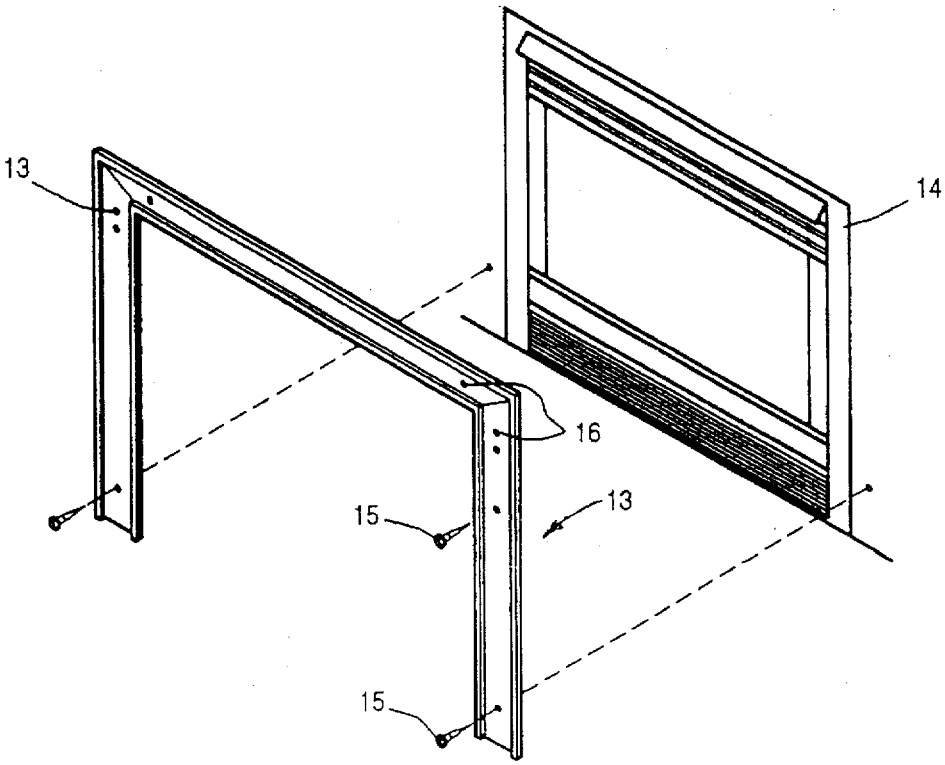
FIG. 2 is an isometric drawing showing the present invention versatile surround trim separated from the removable front of the gas fireplace insert unit.

Refer now to FIG. 2 showing an isometric drawing of the present invention versatile surround trim 13 which is separated from the front cover 14 of the prefabricated fireplace unit 11 on which the trim piece 13 nests or abut. The versatile surround trim 13 is preferably mounted on the flat surface adjacent the cover 14 by screws 15 which are flush mounted into a recess of the surround trim piece 13 through countersunk apertures 16 therein.

Figure 3:
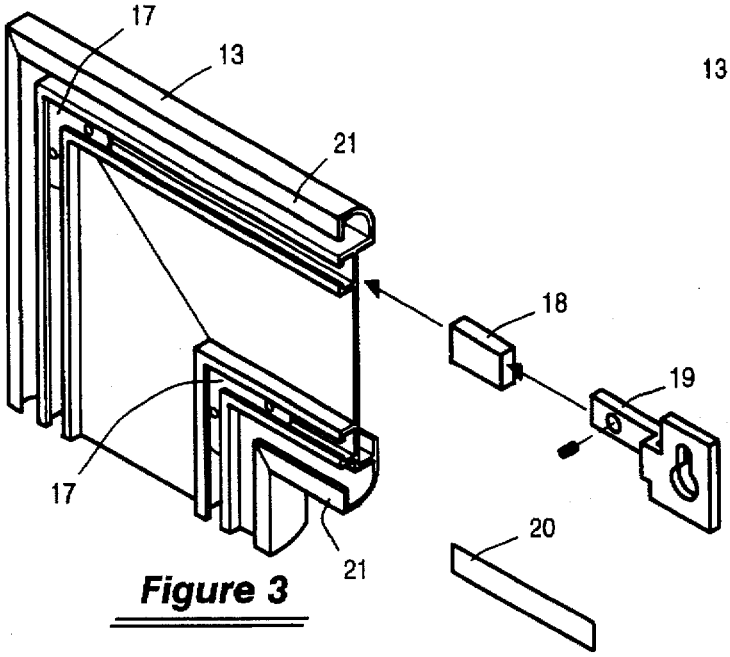
FIG. 3 is an enlarged isometric drawing of the back of a corner of the versatile surround trim showing connecting brackets and alternative mounting means.

Refer now to FIG. 3 showing an enlarged isometric drawing of the back of a corner of the versatile surround trim 13 and showing connecting brackets 17 and a plurality of alternative mounting means 18, 19 and 20. In addition to the screws 15, it is possible to mount the trim piece 13 onto a metallic surface using magnets 18 inserted in guides of the surround trim which receive the corner lock brackets 17. Further, keyhole type mounting slots with extension pieces 19 may also be fitted into the guides which receive the brackets 17 and magnets 18 for positioning over a screw or nail. Further, in some environments, it is possible to place double sticky adhesive strips 20 on the back of the parallel trim edges at 21 if there is no heat environment which would destroy the adhesive strip 20.

Figure 4:
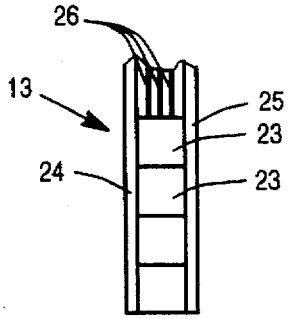
FIG. 4 is a front view of a vertical leg of the surround trim shown in FIGS. 1 and 2 with removable tiles inserted.

Refer now to FIG. 4 showing a front view of a vertical leg of the surround trim 13 shown in FIGS. 1 and 2 with removable tiles 23 mounted in the versatile surround trim 13. The tiles 23 are mounted in a recess between the parallel trim edges 24 and 25 which will be explained in greater detail hereinafter. In the bottom of the recess between the trim edges 24 and 25, there is provided a raised heat isolating tile stand-off 26 to be explained hereinafter.

Figure 5:
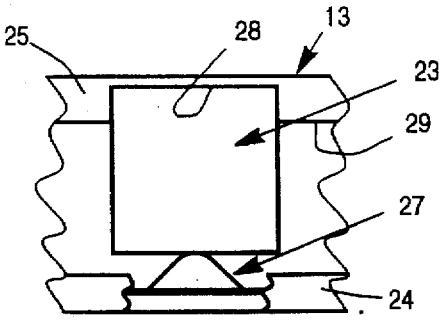
FIG. 5 is an enlarged front view of a portion of a horizontal leg of the surround trim showing a tile being inserted.

Refer now to FIG. 5 showing an enlarged front view of a portion of a horizontal leg of the surround trim 13 and showing a tile 23 being mounted in the recess between the trim edges 24 and 25 against the force of a resilient retaining spring 27.

Figure 6:
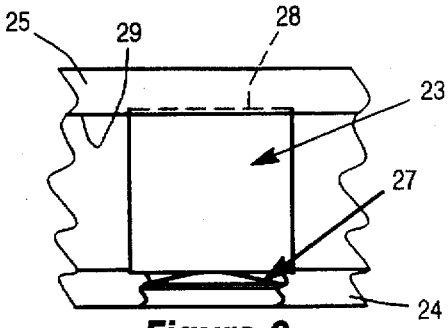
FIG. 6 is an enlarged front view of a portion of a horizontal leg of the surround trim showing a tile after being inserted.

Refer now to FIG. 6 showing an enlarged front view of a portion of horizontal leg of the surround trim 13 showing a tile 23 after being inserted between the trim edges 24 and 25. The tile is pressed against the spring 27 downward until the top edge 28 clears the retaining extension 29 of the trim edge 25 and is then pushed downward into the recess between trim edges 24 and 25 and allowed to move upward and lock under the inward extension 29 of trim edge 25.

Figure 7:
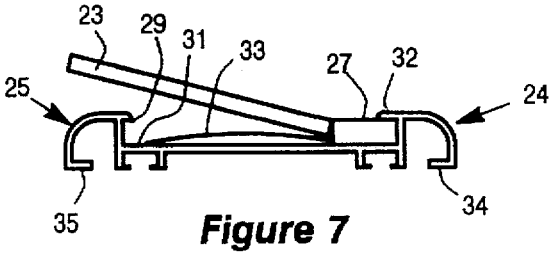
FIG. 7 is a side view in partial section of the surround trim showing a tile being inserted under the long retaining extension.

Refer now to FIG. 7 showing a partial section of the surround trim 13 on which a tile 23 is being pushed against the spring 27. The tile will be pressed under the inward extension of trim edge 24 until it clears the tile retaining extension 29 and will be pressed down upon the recess 31 between trim edges 24 and 25 and then released so as to be retained by the inward extending tile retaining extensions 29 and 32. In the embodiment of FIG. 7 there is shown a spacer element 33 which may be used for standard 4¼" by 4¼" tiles. It is not commonly understood that standard tiles are only approximately 4¼" by 4¼" and are provided with protrusions on the edge for spacing the tiles one from the other to receive grout.

However, custom tiles are normally slightly thicker than standard tiles and are usually 4⅜"×4⅜". It will be appreciated that the space under the tile retaining extensions 29 and 32 is sufficient to receive both a custom tile and a standard tile and made to fit tight using a spacer element 33 if so required.

The rear of the versatile surround trim piece 13 is further provided with heat stand-off means 34 and 35, connected to trim edges 24 and 25 respectively and will be explained in greater detail hereinafter.

Figure 8:
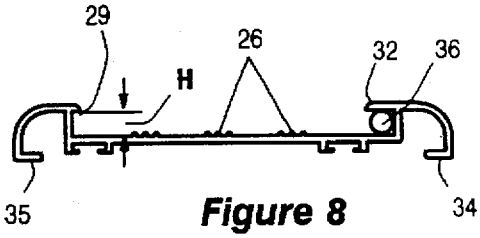
FIG. 8 is a side view in enlarged section taken through a leg of the surround trim showing details of the heat isolating protrusions and tile retaining extensions.

Refer now to FIG. 8 showing an enlarged side view taken through a leg of a surround trim piece 13 showing details of the heat isolating protrusions 26, 34 and 35. Further, it will be noted that the tile retaining extension 32 is preferably longer than the tile extension retaining extension 29 for receiving under the inward extension 32 a resilient round tube like structure 36. The piece of extruded silicon rubber 36 is used as an alternative to the aforementioned resilient retaining spring 27.

Figure 9:
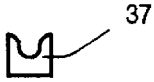
FIGS. 9 to 11 are schematic drawings of alternative resilient biasing means for retaining tiles in the recess of the surround trim.

Refer now to FIG. 9 showing a schematic cross-section of an alternative shape high temperature silicon rubber strip 37 which may be used in place of the resilient retaining spring 27.

Figure 10:
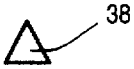

FIG. 10 shows another alternative high temperature resilient silicon rubber shape 38 may be employed in place of the shape 37 shown in FIG. 9.

Figure 11:
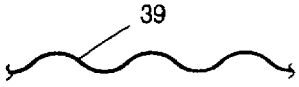

Refer to FIG. 11 showing a continuous formed resilient retaining spring 39 which may be placed in the channel formed under the tile retaining extension 32 to provide a resilient retaining spring for the tiles 23.

Having explained a preferred embodiment decorative, versatile surround trim, it will be appreciated that the surround trim may be viewed as an accessory allowing designers and homemakers to custom tailor a decorative surround trim 13 with enumerable alternatives for different seasons. For example, colored glass, leaded glass, different types of mirrors, marble, metal, marble plastic marble, photographic marble, customized square or rectangular tiles or even pieces of decorative wood formed to the right thickness and width may be placed in the channel shaped recess 31 and biased against one of the supporting sides which forms the channel shape.

It was not uncommon for persons buying new homes to select tile colors for fireplaces and belatedly discover that the limited number of tile colors did not match the surrounding rugs, wall and woodwork. It was not uncommon to completely rip out new tile in new houses and replace it with a new custom color to accommodate a home buyer. Further, when fireplaces are made from delicate, thin pieces of pre-cut marble, granite and mirrors, it was not uncommon to have this material shipped in special crates only to arrive in more pieces than were originally shipped. Problems associated with attempts to match custom marble and mirrors can be completely avoided by the novel versatile surround trim which may be installed before selecting the blocks of decorative material to be inserted in the surround trim.

Another feature of the novel versatile surround trim permits the builder to install the surround trim in a matter of minutes and defer the details of easily installing custom tiles or custom colors in the surround trim to the homeowner or buyer. Further, this allows the homeowner to have a plurality of sets of tiles for different seasons and different occasions to meet the needs of interior decorators.

As explained hereinbefore changing the decorative tiles 23 requires only a matter of minutes and if done correctly may be easily done without harming the decorative tiles or material removed and reinserted from time to time.

What is claimed is:

1. A versatile surround trim mounting device, comprising:

a metal trim piece having a pair of parallel trim edges separated from each other, rigid tiles mounted in said metal trim piece, a recessed tile support connected between said parallel trim edges and having a base support and two side supports engaging edges of each said rigid tile, a tile retaining extension on each said trim edge extending parallel to and inward over the recessed tile support, and resilient tile retaining means mounted under one of said tile retaining extensions against one said side support biasing said rigid tiles placed in the recessed tile support against the other of said side supports and locking the edges of said rigid tiles under the tile retaining extensions.

2. A versatile support trim as set forth in claim 1 which further includes heat isolating stand-off means on each of said parallel trim edges.

3. A versatile support trim as set forth in claim 1 which further includes a heat isolating tile stand-off means on the base support of said recessed tile support.

4. A versatile surround trim mounting device, comprising:

a metal surround frame for a fireplace, said surround frame comprising a pair of vertical legs and a horizontal leg connected together forming a joint between legs, each said leg of said frame comprising an identical extrusion, said extrusion having a pair of parallel trim edges separated from each other by having a connecting recess tile support therebetween, said recess tile support having a base support and two side supports, said trim edges each having a tile retaining extension extending inward over said base support, and means for retaining tiles in said recess support by biasing tiles against one of said side supports of said recess tile support.

5. A versatile surround trim as set forth in claim 4 wherein said means for retaining tiles in said recess tile support comprises resilient biasing means mounted against one of said side supports.

6. A versatile surround trim as set forth in claim 5 which further includes heat stand-off means on each of said trim edges.

7. A method of making a versatile surround trim structure, comprising the steps of:

extruding a trim piece having a pair of parallel trim edges and a connecting recess therebetween for receiving tiles therein, cutting three leg pieces from said extruded trim piece, joining said legs at a 45 degree joint to form a U-shaped surround trim, mounting said U-shaped surround trim around a metal fabricated fireplace, mounting rigid decorative tile shaped objects in said connecting recess between said trim edges, and applying a spring biasing force parallel to the plane of the tile in said connecting recess to retain said tile shaped objects in said connecting recess.

* * * * *